United States Patent [19]

Pessina et al.

[11] 4,346,882

[45] Aug. 31, 1982

[54] JOGGING DEVICE

[76] Inventors: Giorgio Pessina; Aldo Perobelli, both of Via Arborina 2, Paderno-Dugnano, Italy

[21] Appl. No.: 146,204

[22] Filed: May 5, 1980

[30] Foreign Application Priority Data

May 18, 1979 [IT] Italy ..... 22808 A/79

[51] Int. Cl.[3] ..... B65H 31/38

[52] U.S. Cl. ..... 271/221; 271/223; 414/36

[58] Field of Search ..... 271/221, 222, 223, 224, 271/240, 238; 414/36

[56] References Cited

U.S. PATENT DOCUMENTS

| | | | |
|---|---|---|---|
| 1,235,477 | 7/1917 | Howard | 271/222 |
| 1,260,017 | 3/1918 | Novotny et al. | 271/221 |
| 1,421,868 | 7/1922 | Volkmere | 271/221 |
| 1,554,590 | 9/1925 | McGarvin | 271/222 |
| 2,027,341 | 1/1936 | Hornbeck et al. | 271/221 |
| 2,341,021 | 2/1944 | Curtis | 271/221 X |

*Primary Examiner*—Bruce H. Stoner, Jr.

*Attorney, Agent, or Firm*—Kirschstein, Kirschstein, Ottinger & Cobrin

[57] ABSTRACT

A jogger device for jogging signatures or sheets during the formation of stacks in bookbinding machines, such as loaders, including an oscillating disk which is driven of reciprocating motion by a source of reciprocating motion and transmits said reciprocating motion to the supports of two side jogging vanes. Thus, the jogging device can have reduced transversal dimensions. The central vane of the device is carried by the element imparting the reciprocating motion to the oscillating disk.

8 Claims, 3 Drawing Figures

JOGGING DEVICE

BACKGROUND OF THE INVENTION

This invention relates to a jogger device, in particular a device for jogging signatures or sheets during the formation of stacks in bookbinding machines, such as loaders, collators, and the like.

Signature or sheet joggers, for use in forming stacks as indicated, are known per se. However, such known joggers or knock-up devices have the disadvantage of requiring a large number of component parts and being of considerable bulk.

OBJECTS OF THE INVENTION

This invention sets out to provide a jogger device capable of obviating the drawbacks mentioned hereinabove.

SUMMARY OF THE INVENTION

According to one aspect of this invention, there is provided a jogger device, particularly for jogging signatures or sheets during the formation of stacks in bookbinding machines, comprising a source of rotary motion, a supporting structure, and jogging vanes, characterized in that it further comprises a means for converting said rotary motion into reciprocating linear motion, a means for transmitting said reciprocating linear motion to a central jogging vane as well as to an intermediate oscillating element driving side jogging vanes, said oscillating element being advantageously provided with coupling elements cooperating with mating coupling elements provided on axially displaceable elements associated with guide elements rigid with said supporting structure and carrying, preferably in an adjustable manner, a respective side jogging vane on the outer portion thereof, and preferably detachable means for fastening said jogger device.

Advantageous variations and modifications of the jogger device according to the invention can be inferred from the subordinate claims appended hereto.

BRIEF DESCRIPTION OF THE DRAWINGS

Further features, advantages and details of the jogger device according to this invention, will be more clearly understood from the description which follows of a jogger device, as illustrated by way of example only in the accompanying drawings, where.

DESCRIPTION OF THE PREFERRED EMBODIMENT

Figure 1:
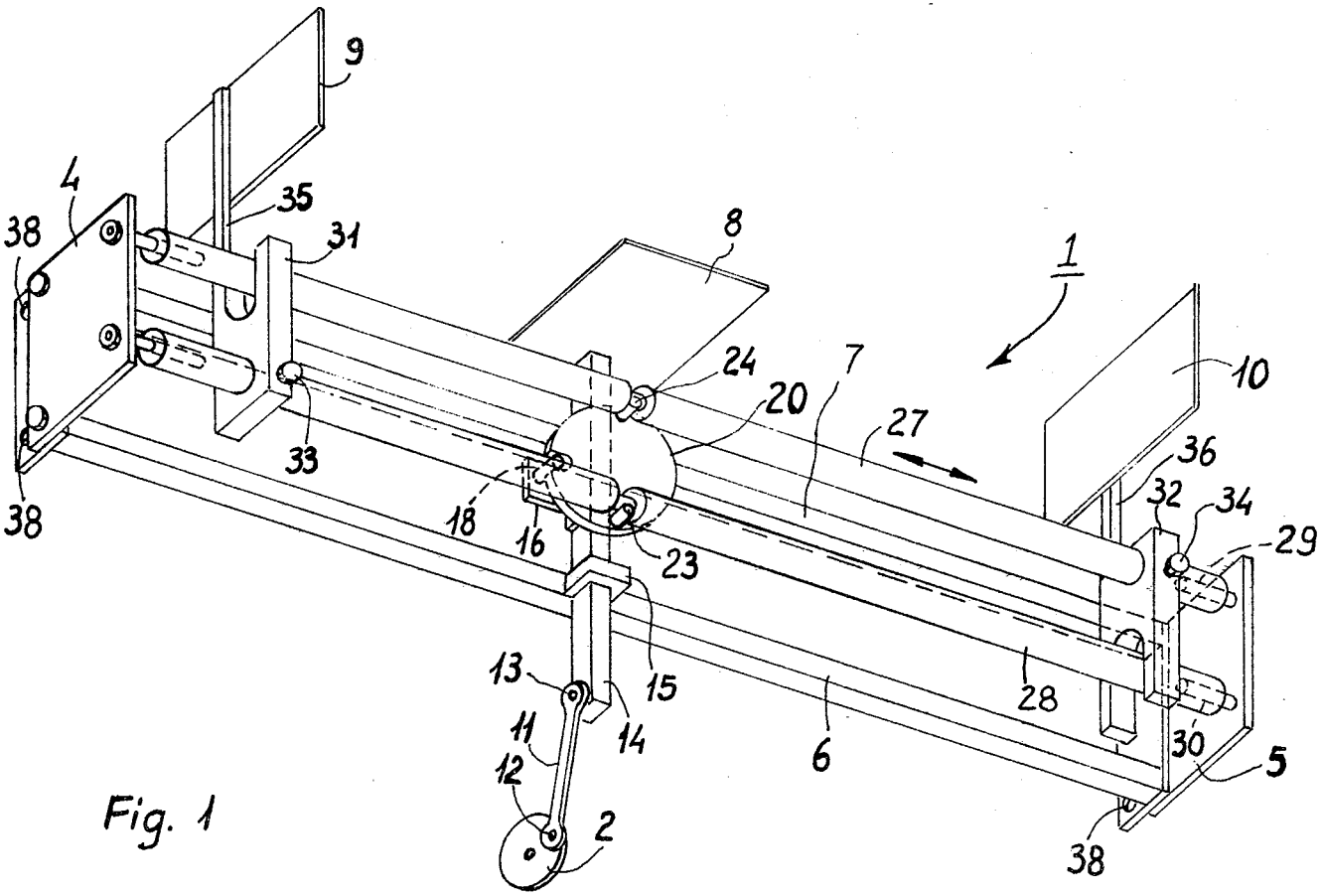
FIG. 1 is a perspective view of a jogger device according to the invention.

The jogger device according to this invention is indicated, in the cited drawing figures, at 1. It comprises a rotary motion source composed of a pulley 2 which, through a drive belt 3, is connected to the output shaft of an electric motor, not shown, with the optional interposition of a speed reducing pulley or gear, also not shown.

The jogger supporting frame, of substantially parallelepipedal configuration, comprises two side members 4,5 and two interconnecting frame rods 6,7, which are coplanar in the exemplary embodiment shown and secured to the side members 4,5 by screw fasteners. A central jogging vane is indicated at 8, the numerals 9 and 10 designating respective side jogging vanes.

In order to convert the rotary motion of the pulley 2 into reciprocating linear motion, as required to move the vanes 8–10 according to the invention, there is provided a connecting-rod 11, on one end attached offcenter at 12 to the pulley 2, and on the other end, attached to a pin 13 on a link 14, of square cross-section in the example shown, which is slidably received in a support 15 secured to said frame rods 6,7. Advantageously, according to the invention, the pins 12,13 are formed with spherical embossments intended for engagement with the connecting rod ends, the latter being correspondingly provided with spherical coupling sockets articulated to the middle portion of the connecting rod. In this manner, a very smooth or uniform reciprocating linear motion of the link 14 is accomplished.

Figure 2:
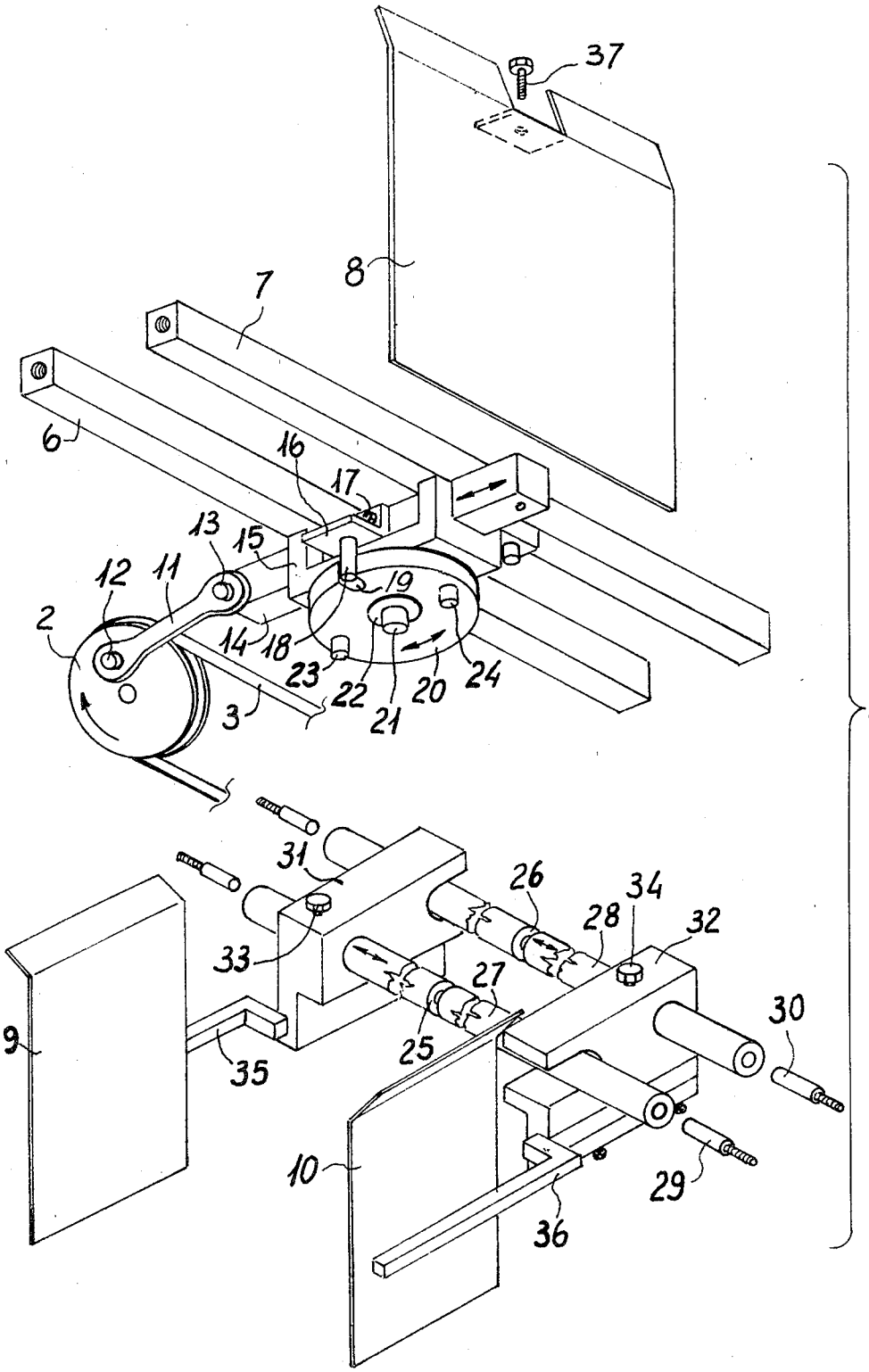
FIG. 2 shows the upper and lower portions of the jogger device in perspective and moved apart, the upper part being viewed from below and the lower part being viewed from above. Moreover, these two parts are turned 90° with respect to each other for convenience of illustration. To understand the correct relative positions of the two portions, it is noted that the view of the lower portion has been turned 90° counterclockwise from its correct position. Moreover, elements of the upper portion, namely, the central jogging vane and the screw which holds it in position, have been shown separated from the element on which they are mounted and turned 180°, again for convenience of illustration.

As is more clearly shown in FIG. 2, to one side of the link 14, there is attached an angled supporting bracket 16 by means of two screws, one whereof is indicated at 17. The bracket 16 has a pin-like projection 18 which is accommodated in a radial slot 19 provided in an oscillating disk 20 The disk 20 is carried for free rotation by the support 15 with the aid of a setscrew 21 and washer 22. The disk 20, in turn, is formed with two pin-like projections 23, 24 which are located at diametrically opposed positions. The projections 23,24 form coupling elements which, in operation, cooperate with mating coupling elements constituting gaps 25, 26 provided respectively in axially shiftable rods 27, 28. The latter are of hollow construction, at least over part of their end portions, and are carried for axial movement on end supporting pins or stub shafts 29, 30 which have a threaded end inserted in correspondingly threaded holes in the side members 4, 5 of the jogger.

The reference numerals 31, 32 designate supporting elements for the side jogging vanes 9, 10, screws 33, 34 enabling the support 31, or 32, to be locked to the rods 27, 28 in any desired position. Vane supporting stems 35,36 of the side vanes 9, 10 are attached to the supporting elements 31, 32 in an adjustable manner, e.g. by means of screws. The central vane 8 is secured, e.g. by a screw 37, to the free end of the square link 14.

The lengths of the axially shiftable rods 27, 28, or supporting elements for the side vanes 9, 10, will be in practice less than the inside distance separating the side members 4, 5, and more specifically in the same order as the stroke distance of said vanes 9, 10. This construction affords an arrangement of extremely compact dimensions.

According to the invention, this jogger device can be secured to the stack forming, or receiving, machine or device, e.g. a loader, by directly fastening it with screws. For this purpose, use is made of the holes 38 provided in the side members 4, 5.

The foregoing structural description will make the operation of the inventive jogger device self-evident. The reciprocating linear motion of the square link 14, as derived from the rotary motion of the pulley 2 through the connecting rod 11, is utilized to simultaneously impart a reciprocating linear movement to the central vane 8, and through the oscillating disk 20 and axially shiftable rods 27, 28, to the side vanes 9, 10. The provisions for axial adjustment of the supports 31, 32, as well as for adjustment of the supporting arms or stems 35, 36, enables an easily and quickly carried out adaptation of the jogger to the size of the stack being handled.

Figure 3:
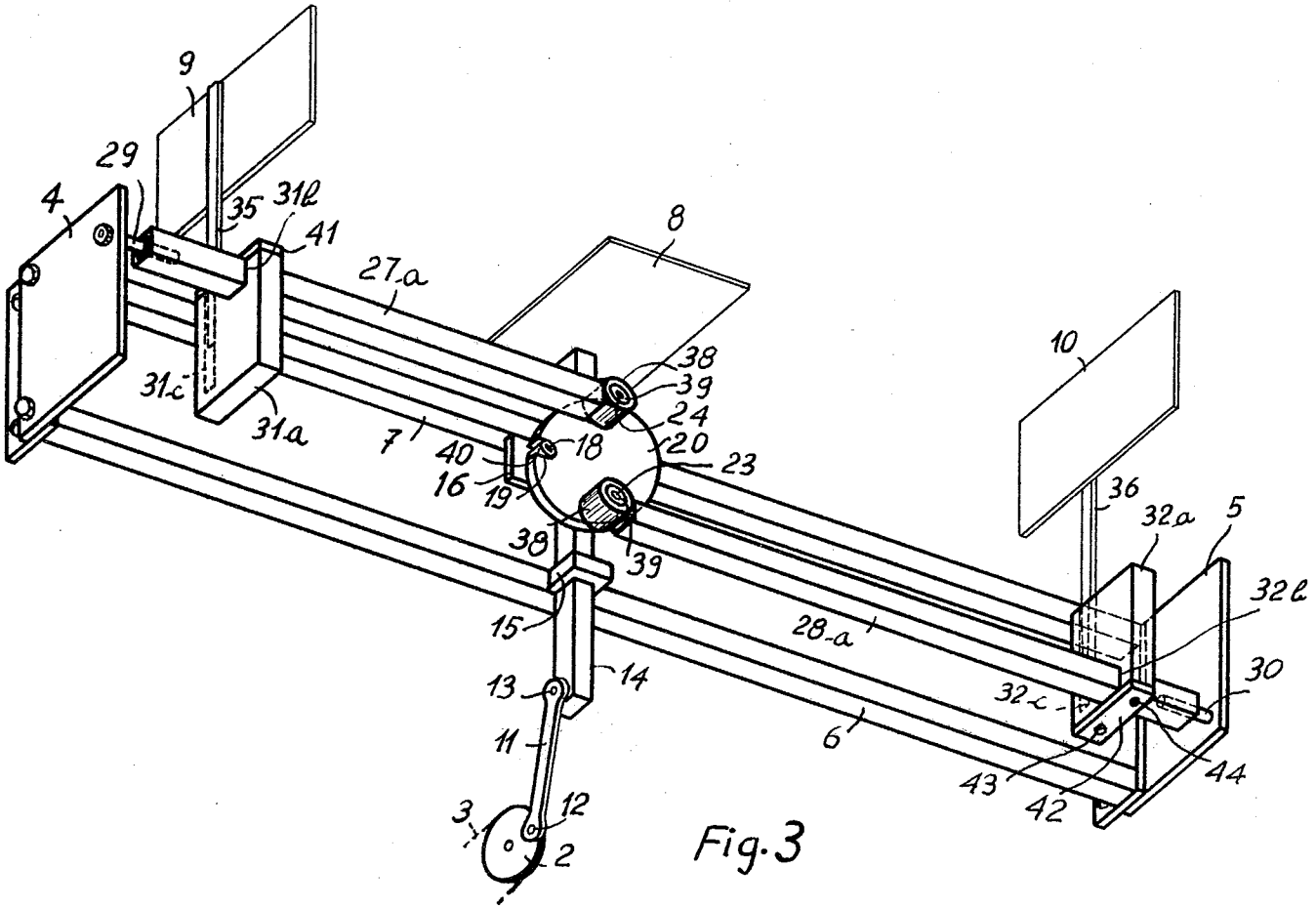
FIG. 3 illustrates a variation of the jogger device according to the invention.

FIG. 3 illustrates another embodiment of the jogger device according to this invention. This embodiment has special advantages, in that it permits a reduction of the inertiae of the axially movable parts, a reduction in material requirements, while affording an extremely silent operation and preventing the occurrence of play at the gaps 25, 26 on the rods 27, 28.

In this embodiment, the axially shiftable rods 27*a*, 28*a*, have a length dimension which is virtually one half the length of the axially shiftable rods 27, 28 of the previously described embodiment. Such axially shiftable rods 27*a*, 28*a*, also engage, with their ends facing the side members 4, 5, pins or stub shafts 29 and 30, whilst their other ends carry a respective eye 38 welded thereto, which is inserted, preferably with the interposition of a bearing 39, onto pin-like projections 23, 24 of the disk 20. In this embodiment, moreover, there is provided a bearing element 40 on the pin-like projection 17, said bearing 40 being received in the recess 19. The supporting elements 31*a*, 32*a* have a substantially parallelepipedal configuration and have a seat or socket 31*b*, 32*b*, accommodating one rod 27*a*, 28*a*, respectively. The numerals 41, 42 designate cap elements which are secured to the parallelepipedal bodies 31*a*, 32*a* by means of screws 43 and guided on a respective pin 44 attached to the bodies 31*a*, 32*a*. The stems 35, 36 of the vanes 9, 10 are received in a groove 31*c*, 32*c* of the bodies 31, 32 and can be locked therein by means of a screw, not shown. These parallelepipedal bodies 31, 32 are preferably formed from a plastics material. In the embodiment shown, the displaceable elements 27*a*, 28*a* are hollow extrusions, the pins 29, 30 being preferably formed from a plastics material.

The operation of this embodiment is entirely similar to that of the jogger shown in FIGS. 1 and 2, this embodiment affording, as mentioned, an extremely silent operation, less moving masses, less material, and a more uniform operation without developing undue play.

Furthermore, the invention provides for the incorporation or association with the jogger device of a variable speed motive source, and this to allow varying rates of movement of the vanes in conformity with the type of paper composing the signatures or sheets to be stacked. In fact, high rates would be used for light, thin and easily deformable or highly flexible paper, whereas lower rates would be preferable for stiffer paper. The reciprocating motion drive sources may be indifferently of the electric, hydraulic, pneumatic or any other desired types, in the case of an electric source, the same advantageously including an electronic speed variator.

From the foregoing explanations, it will be appreciated that the jogger devices according to this invention effectively achieve their objects and secure the cited advantages, in particular that of an extremely compact overall size and that of a limited number of components.

From a constructional standpoint, moreover, the jogger of this invention can be manufactured in a simple manner, and operates in a reliable and noiseless fashion.

In practicing the invention, all of the parts can be replaced with other functionally equivalent elements. For example, the pulley and associated connecting rod may be replaced with a rack and pinion, or the angle bracket with projection for the quadrangular rod may be replaced with an integral projection, and the oscillating disk may be replaced with a gear wheel meshing with inner rectilinear racks provided on the displaceable elements of the side vanes, which gear wheel could be provided with an additional tooth formation for driving a toothed rod carrying the central vane, and so forth without departing from the scope of this invention.

The dimensions and materials may also be selected at will, without departing from the invention scope.

All of the features that may be inferred from this description, the accompanying drawings and appended claims are substantial to this invention, whether individually or in any desired combination thereof.

We claim:

1. A jogger device for jogging signatures or sheets during the formation of stacks in bookbinding machines, said jogger device comprising:

(A) a source of rotary motion, (B) a supporting structure, (C) a central jogging vane, (D) two side jogging vanes, (E) displaceable elements supporting said central and side vanes from said supporting structure for jogging movement relative to said structure, (F) means for converting the rotary motion of said source of rotary motion to reciprocating motion, (G) one of said displaceable elements constituting an elongated straight element, (H) means mounting said straight element for axial reciprocation, (I) means securing the central vane to the straight element, and (J) means adjustably connecting the side vanes to the displaceable elements for the same, characterized in that:

(K) said supporting structure constitutes two side members connected by two elongated mutually spaced transverse members, (L) said means for mounting said axially reciprocating straight element being supported by said two mutually spaced transverse members, (M) a bracket mounted on said axially reciprocating straight element, (N) a pin carried by said bracket, (O) an oscillating element rotatably mounted on said support means for said reciprocating straight element, (P) a pair of pins carried by said oscillating element at diametrically opposed points with respect to the axis of rotation of the oscillating element, (Q) a radial slot in the oscillating element in which the bracket pin rides, (R) two transverse rods mutually spaced apart and located between said side members, (S) means mounting said rods for independent axial reciprocation, (T) said rods being shorter than the distance between the side members, (U) each of said rods having means thereon for engaging a different one of the pins supported by the oscillating element, and (V) said displaceable elements which support the side vanes being adjustably connected to different ones of the rods, (W) whereby rotation of the source of rotary motion jogs the central vane in a direction transverse to the axially reciprocating members and jogs the side vanes in a direction transverse to the jogging direction of the central vane.

2. A jogger device according to claim 1, which is further characterized in that each of the rods has a length which is a little shorter than the distance between the two side members.

3. A jogger device according to claim 2, which is further characterized in that the means mounting the rods for independent axial reciprocation constitute stub shafts carried by the side members.

4. A jogger device according to claim 3, which is further characterized in that the stub shafts are of plastic material.

5. A jogger device according to claim 1, which is further characterized in that each of the rods has a length which is a little less than half the distance between the two side members.

6. A jogger device according to claim 5, which is further characterized in that each rod carries at an end thereof an eye engaged with a different one of the pins of the pair of pins carried by the oscillating element.

7. A jogger device according to claim 1, which is further characterized in that the means for converting the rotary motion of the source of rotary motion to reciprocating motion is a connecting rod connected at opposite ends thereof with spherical coupling sockets to the source of rotary motion, on the one hand, and to the axially reciprocating member, on the other hand.

8. A jogger device according to claim 1, which is further characterized in that the displaceable elements that support the side vanes constitute supporting elements attachable by locking means to a rod, the rod being different for each of the supporting elements, and the supporting elements having grooves which accommodate the other rod.

* * * * *